United States Patent [19]

Burnett

[11] 4,223,424

[45] Sep. 23, 1980

[54] BANK BAG SEALER

[75] Inventor: Ralph G. Burnett, Kenosha, Wis.

[73] Assignee: American Casting and Manufacturing Corporation, Plainview, N.Y.

[21] Appl. No.: 951,569

[22] Filed: Oct. 16, 1978

[51] Int. Cl.[2] ..... B65D 77/10; B65D 63/00

[52] U.S. Cl. ..... 24/30.5 R; 24/16 PB; 24/20 TT; 24/206 A

[58] Field of Search ..... 24/30.5 P, 30.5 R, 16 PB, 24/20 TT, 206 A

[56] References Cited

U.S. PATENT DOCUMENTS

| | | | |
|---|---|---|---|
| 2,654,624 | 10/1953 | Canter et al. | 24/30.5 R |
| 2,936,980 | 5/1960 | Rapata | 24/16 PB |
| 2,977,145 | 3/1961 | Rifkin | 24/16 PB |
| 3,149,808 | 9/1964 | Weckesser | 24/16 PB |
| 3,537,146 | 11/1970 | Caveney | 24/16 PB |
| 3,581,347 | 6/1971 | Verspieren | 24/16 PB |
| 3,748,697 | 7/1973 | Marchese et al. | 24/20 TT |
| 3,900,923 | 8/1975 | Thomas | 24/16 PB |
| 4,008,512 | 2/1977 | Prodel | 24/16 PB |
| 4,045,843 | 9/1977 | Loose et al. | 24/16 PB |

FOREIGN PATENT DOCUMENTS

| | | | |
|---|---|---|---|
| 508037 | 1/1955 | Italy | 24/206 A |

*Primary Examiner*—Victor N. Sakran

*Attorney, Agent, or Firm*—Allegretti, Newitt, Witcoff & McAndrews

[57] ABSTRACT

A sealing device for a receptacle such as a heavy cloth bank bag for containing money or currency in which a single strip or band of material formed of metal or plastic is stamped with projections or serrations extending from one side of the band and wherein a pair of locking projections in the form of raised panels are stamped in the material near one end of the band, so that the other flat end thereof may be inserted through slits formed by the stamped panels, whereby one or preferably more of the serrations are engaged and locked by the edges of the panels when the strip is tightened around the neck of the bag. Movement of the ends of the strips are thereby prevented in a direction which would unlock the seal but is freely permitted in the other direction for the extent of the serrations so that a tight seal may be accomplished. The material adjacent the locking panels is provided with sets of inwardly extending teeth at the top and bottom thereof to engage the material of the bag when the sealing device is in place and is tightened, so that the sealing device may not be removed from the bag without tearing or destroying the same and thus immediately provided evidence of tampering or attempted pilferage.

10 Claims, 12 Drawing Figures

BANK BAG SEALER

BACKGROUND OF THE INVENTION

Heretofore bank bags which are usually formed of heavy cloth such as duck or denim for carrying money, currency or the like, have been provided with a seal around the open neck thereof so that access to the interior of the bag or receptacle cannot be attained without breaking the seal, and in this manner, it is immediately apparent whether or not the seal has been tampered with and the interior contents of the bag either removed therefrom or have had some other material which is worthless substituted for the original contents of the bag.

It has been found that with careful manipulation, the former sealing devices used, which were usually formed of a soft material such as lead which was tightened, or deformed after strings were inserted through the holes therein by a tool to restrain or hold strings in place around the neck of the bag, and which has teeth or points which would dig into the bag so that removal of the seal was difficult, did not always serve their intended purpose and were expensive. One reason they were unsatisfactory was that persons with sufficient patience and strength could carefully manipulate the seal so that it could be removed from the bag and the contents thereof either pilfered or changed and the seal could then be carefully replaced around the neck of the open end of the bag with no readily visible indication that the seal had been tampered with. In bank bags, this is a decided disadvantage because such bags at times contain material placed therein with the seal thereon which are not opened for some considerable period of time, and if pilferage or substitution is not discovered immediately, it is difficult to trace the person or persons who may have tampered with the bag or to determine when or where the tampering took place.

Furthermore, such seals were usually formed of materials which are relatively expensive, such as lead, for example, and required a special tool to secure them on the bag after the contents were placed therein.

The present invention provides a very inexpensive and foolproof sealing device for bank bags and the like which cannot be removed from the bag without tearing or mutilating the bag material, whereby it is immediately apparent that the bag has been tampered with and the seal has been removed. The purpose also is to provide a seal of the type described wherein the only manner in which the seal may be removed from the bag is by cutting or severing the same with a cutting tool or otherwise the visual appearance of the bag is such that it will be immediately apparent that the seal was improperly removed and attempted to be replaced although this is quite difficult to do without further mutilating or tearing the bag material. It is also an object of the invention to provide a bag seal which is inexpensive and may be manufactured in large quantities very cheaply from metal stampings or molded plastic strips. Furthermore, to provide a configuration which may be tightly secured to the bag by a person utilizing a simple and inexpensive tool which requires very little strength or force to effect an extremely tight and foolproof seal.

Applicant knows of no other prior art with respect to sealing devices for bank bags and the like other than the deformable lead seal utilized with the cord as shown in FIG. 2 of the drawings of the present application.

SUMMARY OF THE INVENTION

The invention relates to a sealing device for bank bags or the like which is formed from a band of material which circumferentially surrounds and tightly seals the open neck end of the bag when in place and which will visually indicate improper attempts to remove the seal from the bag.

DETAILED DESCRIPTION OF THE PRESENT INVENTION

Figure 1:
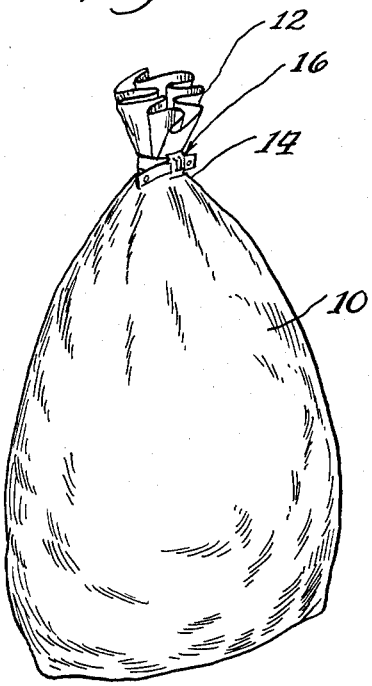
FIG. 1 is a perspective view of a bank bag having the sealing device of the present invention secured thereto to close the opening at the top or neck of the bag.

FIG. 1 illustrates a bank bag 10 which is usually formed of heavy cloth material such as duck, denim, or other heavy cloth. The bag 10 is provided with an open top 12, which is at the top of the bag and when the bag is closed, the material of the bag may be gathered together to form a neck 14.

Figure 3:
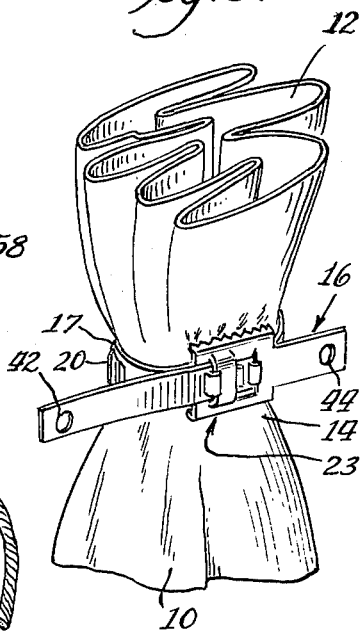
FIG. 3 is a partial enlarged perspective view of the sealing device of the present invention in position around the neck of the open end of the bag.
Figure 4:
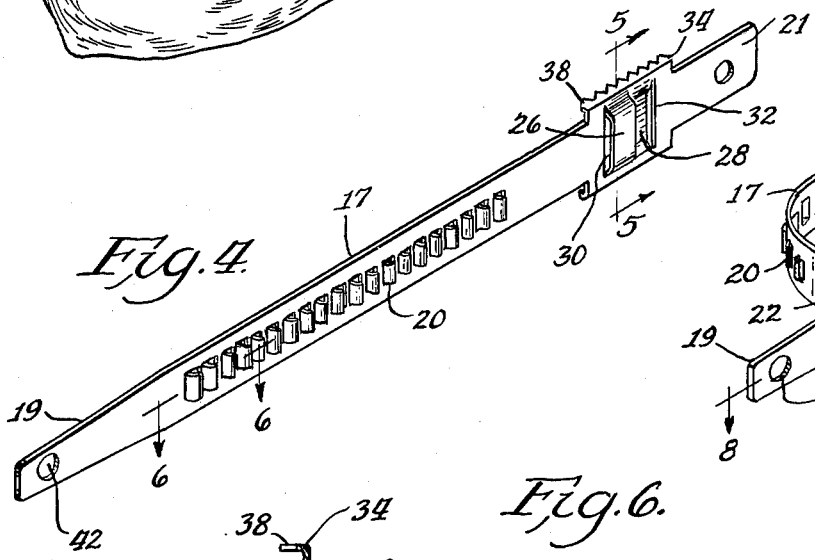
FIG. 4 is a perspective view of the sealing device shown in FIG. 3 before it is placed upon the bag.
Figure 7:
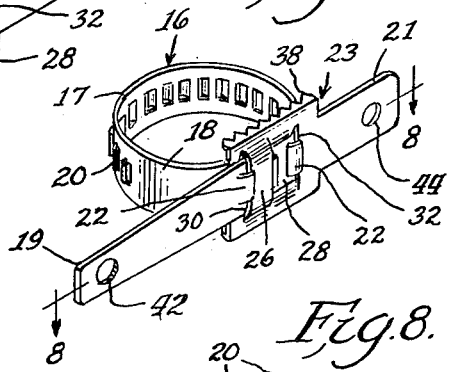
FIG. 7 is a perspective view of the sealing device shown in FIG. 4 when the ends thereof have been placed in the locked position to provide a circumferential or ring-like sealing position.
Figure 5:
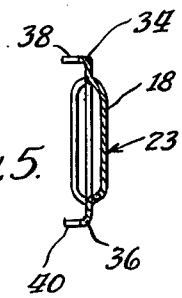
FIG. 5 is a sectional view of the sealing device taken on line 5—5 of FIG. 4.
Figure 6:
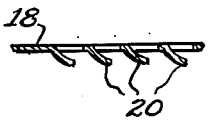
FIG. 6 is a sectional view of the sealing device taken on line 6—6 of FIG. 4.
Figure 8:
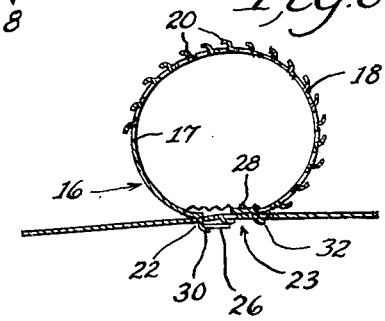
FIG. 8 is a sectional view taken on line 8—8 of FIG. 7.
Figure 9:
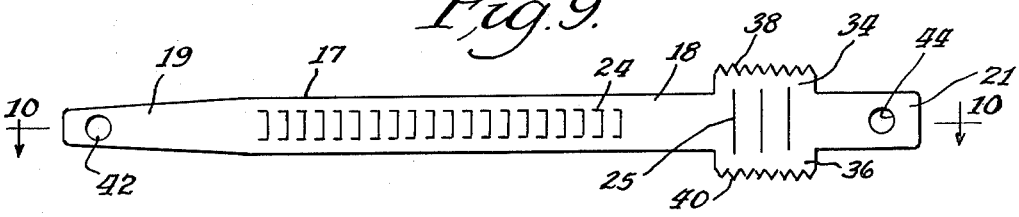
FIG. 9 is a plan view of the sealing device before the various finished stamping operations have been performed thereon.

A sealing device generally indicated at 16 is placed around the neck of the bag as shown in FIGS. 1 and 3. The sealing device 16 comprises a strip of flexible material in the form of a blank or band 18 as shown in FIG. 9 formed of metal such as aluminum or steel or heavy and strong plastic material. The blank or band 18 as shown in FIG. 9 is provided with a central body portion 17 and ends 19 and 21 having holes 42 and 44, respectively, formed therein. The band is formed with a plurality of U-shaped cuts or slits 24 in the body portion 17 and with three vertical cuts or slits 25 near end 21. The band 18 is provided with extensions 34 and 36 adjacent the cuts 25, which are provided with barbs or serrations 38 and 40, respectively, at the top and bottom thereof.

Figure 10:
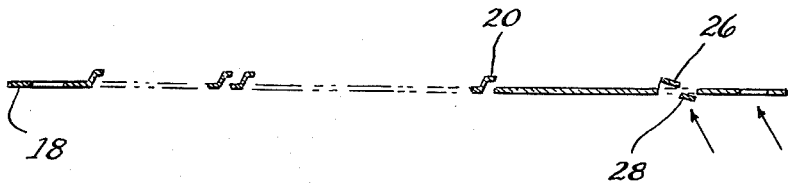
FIG. 10 is a longitudinal transectional view of FIG. 9 taken on line 10—10 thereof.
Figure 11:
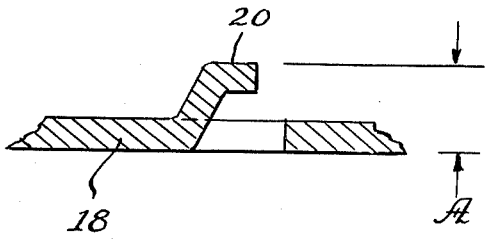
FIG. 11 is an enlarged view of one of the elevated bar-like teeth in FIG. 10.

As shown in FIGS. 4–8, and 10–12, the band 18 has projections or teeth 20 stamped outwardly therefrom from the slits 24 shown in FIGS. 9–11 and all extend toward the end 21 of the strip, which is the end upon which the locking portions of the strip, generally indicated by the numeral 23, are positioned.

Projections in the form of oppositely facing stamped panels 26 and 28 are stamped from the slits 25 of FIG. 9 and form an edge 30 on one of the sides of the panel 26 and an edge 32 on the strip 17 which are to be engaged by two of the projections 20, namely those numbered 22, all as best shown in FIGS. 3, 7, 8, and 10–12.

Also as best shown in FIGS. 7, 8, and 10–12, the inner curved sides of the serrations 22 embrace one side 30 of the panel 26 and edge 32 over a considerable area and locking in one direction of relative movement between the serrations and the straps is accomplished. The locking described definitely prevents relative movement of the strap through the panel locks in the direction which would be required to disassemble the seal, but permits such movement in the opposite direction to accomplish very tight engagement with the neck 14 of bag 10 of what becomes a circumferential shape formed from central part 17 of the band 18.

Figure 12:
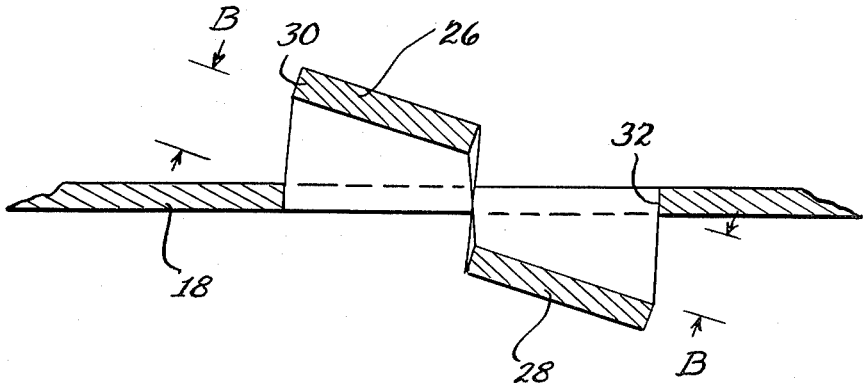
FIG. 12 is an enlarged partial sectional view of the panels shown in FIG. 10.

As shown in FIGS. 11 and 12, the distance between the dimension "A" in FIG. 11 must be slightly greater than the distance "B" in FIG. 12, so that during assembly the bar-like teeth 20–22 are easily admitted and allowed to continue to slide or travel through space "B" by virtue of the spring-back characteristics of the metal (or it may be the plastic) material. By virtue of the same springback characteristics the teeth 20–22 will be prohibited from re-entering space B. Moreover, the tendancy of the compressored bag to expand will cause the teeth 20–22 to hook themselves over the edge 30 of the panel 26 and edge 32 of the band 16. Thus, the seal cannot be loosened except by seriously deforming or destroying the seal 16 or the bag 10.

Triangular barbs 38 and 40 provided on the portions 34 and 36 of the band 16, which portions 34 and 36 are bent inwardly as shown in FIGS. 3, 4, 5 and 7 to engage and dig into the cloth of the bag 10.

When the ends of the strip 18 are pulled away from each other in the position shown in FIG. 3 and the projections 20–22 locked with the panels 26 and edge 32, the serrations 38 and 40 will dig deeply into the neck 14 of the bag and the strip itself will very tightly surround the neck 14 of the bag 10. If a person wishes to open the bag, a cutting tool must be used which will sever the strip 16 so that the seal may be easily removed and the bag opened.

It is noted that the ends 19 and 21 of the strip 16 could be grasped by two pairs of pliers or similar tool and pulled in opposite directions until the strip tightly engages the neck 14 circumferentially thereof with the serrations 38 and 40 digging into the cloth of the bag. If someone attempts to remove the sealing device 16 without cutting it, such removal is impossible without the serrations 38 and 40 multilating or tearing the bag 10 to such an extent that it is readily visible that tampering has occurred and steps can immediately be taken to determine who, when and where such tampering occurred. It is also impossible to reverse the movement of the ends 19 and 21 of the strip to open the seal without damaging it since the cooperation of the projections 20 with the edge 30 of the panel 26 and edge 32 permit movement in one direction only, namely, in a direction to tighten the seal about the neck 14 of the bag 10. Also, it is noted that with the holes 42 and 44 provided in the ends of the strip, a simple scissor-like levered tool with projections thereon (not shown) may be inserted into the holes 42 and 44 and when the scissor-like tool is forced open, the strip is tightened around the neck of the bag to the point of maximum compression. The only effective way to remove the sealing device is to destroy or damage it or the bag. By use of such a scissor-like tool, a person need not have great strength in order to attain a tight tamperproof seal.

Figure 2:
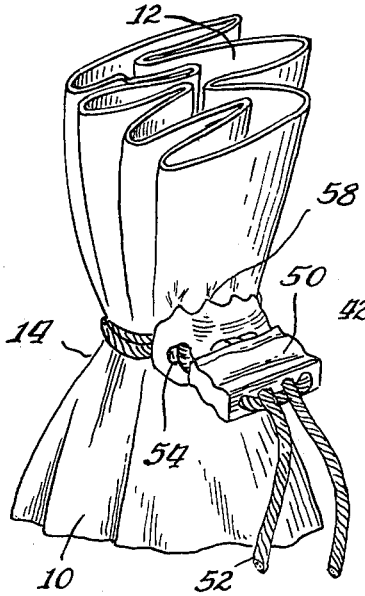
Fig. 2. (PRIOR ART)
FIG. 2 is a partial enlarged perspective view of a prior art sealing device.

The prior art sealing device shown in FIG. 2 includes strings 52 which enter and pass through holes 54 in a piece of deformable metal 56 formed of a lead rectangle or the like which has barbs 58 adapted to engage the material of the bag 10 adjacent the neck 14. In order to use this sealing device it is necessary to loop the strings around the bag and pull them tight. Then the lead rectangle 56 is engaged by a suitable tool and the string 52 is tightened around the bag by rotating the tool. The lead is deformed by squeezing the tool to hold the twine tightly in the holes in the seal and have the barbs or teeth engage the bag to prevent slipping the seal upwardly and off the bag.

However, this sealing device is not satisfactory because it permits the string to be "teased" off the bag, whereupon the contents may be pilfered and possibly worthless material substituted for that which was in the bag originally, and the seal may be replaced without detection of any tampering having been accomplished.

The present device creates a bank bag sealing device which is formed from a single piece of material which is easy to use and which may be secured to the bag with considerable tightness and with relatively little strength necessary on the part of the person applying the sealing device. Also, the bank bag sealing device may be made of metal such as aluminum or steel which would be much stronger and less expensive that the prior art seals, or it may be made very cheaply of strong plastic strip material. Also, the seal of the present invention when formed of metal may be manufactured on an automatic punch press and a much less expensive bag sealing device is provided. Alternatively, an inexpensive seal molded or otherwise formed from strong plastic material may be used.

It is noted that any otherwise sharp corners of the seal are rounded, so that persons will not be scratched or cut by applying the sealing device or handling the bags provided with such seals.

While I have disclosed a presently preferred embodiment of the present invention, the invention is intended to be limited only by the scope of the appended claims.

I claim:

1. A sealing device for a receptacle having at least one open end, which receptacle consists at least in part of deformable material adjacent the open end thereof, so that the material may be gathered together to form a neck, said sealing device comprising a relatively thin band of flexible material which is of sufficient strength that it is manually severable only by cutting through the same, said band comprising an elongated flat body portion and a pair of end portions at the extremities thereof, means for tightly securing the body portion of said band circumferentially about the neck of said receptacle adjacent to said end, with said end portions extending outwardly from the circumferential body portion, means on said band for preventing the seal from being opened to gain access to said receptacle without severing or damaging the band, a plurality of projections formed on one side of the body portion of the band at substantially right angles to the length thereof and bent in one direction toward one end of the band, and locking means adjacent said one end of the band for engaging one or more of said projections, said locking means and said projections permitting relative movement of said band in one direction relative to said locking means and substantially preventing relative movement thereof in the other direction, said locking means comprising a pair of oppositely formed panels extending at substantially right angles to the length of said strip to provide a pair of slits in said band through which the other end of the band is inserted a sufficient distance for at least two of said projections to engage with the edge of one of said panels and with an edge in the strip formed by the other of said panels being locked in position thereby to prevent substantial movement of said second end of the band away from the locking means.

2. A sealing device as claimed in claim 1 wherein material is formed from the band and extends outwardly therefrom in the opposite direction from said projections adjacent the lock, and means on the edges of said outwardly extending material for engaging the deformable material of the neck of the bag to prevent removal of said sealing device without tearing the receptacle or damaging the band.

3. A sealing device as claimed in claim 1 wherein a hole is placed adjacent each end of the band.

4. A device as claimed in claim 1 wherein the band is formed of a single piece of flexible material.

5. A sealing device as claimed in claim 2 wherein the band is formed of a single piece of material.

6. A sealing device as claimed in claim 2 wherein the band is formed of a single piece of metal.

7. A sealing device as claimed in claim 2 wherein the band is formed of a single piece of plastic material.

8. A sealing device as claimed in claim 2 wherein the band is formed of a single piece of material and the projections and the panels are formed integrally therewith.

9. A sealing device as claimed in claim 8 wherein the material for engaging the deformable material is formed integrally with the single strip of material.

10. A sealing device as claimed in claim 1 wherein the distance between the projections and the band is slightly greater than the distance between the edges of the panels and the blank through which said projections on the band are to be inserted.

* * * * *